US005157884A

United States Patent [19]

Schwartz

[11] Patent Number: 5,157,884

[45] Date of Patent: Oct. 27, 1992

[54] SOLELY WALL MOUNTED DROP CEILING STRUCTURE

[76] Inventor: Daniel P. Schwartz, 3606 Edgewood St., Library, Pa. 15129

[21] Appl. No.: 689,653

[22] Filed: Apr. 23, 1991

Related U.S. Application Data

[63] Continuation of Ser. No. 215,403, Jul. 5, 1988, abandoned.

[51] Int. Cl.[5] ..... E04B 9/30

[52] U.S. Cl. ..... 52/487; 52/288; 52/484

[58] Field of Search ..... 52/288, 364, 366, 367, 52/371, 484, 487, 488

[56] References Cited

U.S. PATENT DOCUMENTS

| | | | |
|---|---|---|---|
| 1,229,765 | 6/1917 | Lehman | 52/287 |
| 1,676,582 | 7/1928 | Stuart | 52/371 |
| 3,159,251 | 12/1964 | Becker | 52/484 |
| 3,170,217 | 2/1965 | Williams | 52/488 |
| 3,248,839 | 5/1966 | Roberts et al. | 52/484 |
| 3,405,488 | 10/1968 | Nelson | 52/287 |
| 3,405,489 | 10/1968 | Frisk | 52/484 |
| 4,055,930 | 11/1977 | Weinar et al. | 52/484 |
| 4,150,517 | 4/1979 | Warner, Sr. | 52/288 |
| 4,598,516 | 7/1986 | Groshong | 52/287 |
| 4,642,957 | 2/1987 | Edwards | 52/287 |

FOREIGN PATENT DOCUMENTS

| | | | |
|---|---|---|---|
| 800911 | 12/1950 | Fed. Rep. of Germany | 52/287 |
| 909537 | 5/1946 | France | 52/288 |

*Primary Examiner*—Michael Safavi

*Attorney, Agent, or Firm*—Armstrong, Nikaido, Marmelstein, Kubovcik & Murray

[57] ABSTRACT

A simplified drop celing room conversion is accomplished without, in any manner, disturbing the original ceiling of an office or room by providing integral, generally angle-shaped, longitudinally-extending structural members that are to be securely and fully mounted in an endwise-aligned relation on and about walls of the room at a desired lower ceiling height and, in such a manner as to fully and exclusively serve to support and carry a so-called drop ceiling. Each member has a horizontally-outwardly-extending upper shelf part for fully supporting and carrying cross-extending rail members that define open spaces therebetween with the sidewall-mounted supporting structural members, and which with the supporting members, are adapted to tilt-in receive dry wall ceiling panels in the spaces therebetween. The structural members are of a unique construction embodying a horizontally extending ceiling-receiving shelf part, an intermediate connecting tool-guiding part or bead, and a downwardly extending wall mounting vertical leg part. Each support member is self-sufficient in that the exposed underside of the upper shelf part is provided with a finish strip, and the bead has a slightly backwardly sloped and downwardly offset guide face to receive and accurately guide an edge portion of a tool blade therealong in such a manner as to spread a finishing compound, such as spackling, in a smoothly fully covering, and downwardly feathering-off relation over the exposed front face of the mounting foot part and its associated wall-securing elements, such as screws or nails that are carried thereby.

1 Claim, 1 Drawing Sheet

SOLELY WALL MOUNTED DROP CEILING STRUCTURE

This is a continuation of my application Ser. No. 215,403 filed Jul. 5, 1988, abandoned.

This invention relates to a structural member construction for facilitating the installation of a drop ceiling in previously finished rooms of an office building or a dwelling. It deals particularly with the provision and use of structural members that eliminate the need for disturbing the original ceiling in a room and enables the simple and easy installation of a modernizing drop ceiling therefor.

It has thus been an objection of the invention to solve the problem heretofore involved in modernizing rooms in a previously constructed building, such as a home or office, from the standpoint of lowering the ceiling thereof.

Another object has been to devise and provide structural members which may be mounted in a horizontally aligned relation at a desired ceiling height on walls of a room for receiving and fully supporting a drop ceiling, and which may be utilized in such a manner as to, themselves, preserve the aesthetic appearance effect of the room.

A further object of the invention has been to devise a structural member construction for a drop ceiling which may be solely mounted and supported on the side walls of the room and which will, without the use of additional members, provide for and enable an overall finished appearance to the room when thus utilized.

A still further object has been to enable an accurately guided single stroke finish-covering of wall mounting legs of a room wall mounted drop ceiling support framing.

These and other objects of the invention will appear to those skilled in the art from the illustrated embodiments and the description thereof.

IN THE DRAWINGS

FIG. 1 is a fragmental perspective view in elevation of a corner of a room illustrating the employment of side wall mounted structural members of my invention; this view is partially broken-away to show the longitudinally endwise aligned, about the room positioning of structural members of my invention to enable fully carrying a rail-like framework thereon, along with conventional drop ceiling panels;

Having been actively engaged in the remodeling of finished rooms of buildings such as homes and particularly offices, I have encountered a problem from the standpoint of a frequent requirement in such remodeling of lowering room ceilings. In accordance with methods heretofore employed, it has been necessary in my experience to enter or disturb the original ceiling, as by overhead hooks and suspending wires, in order to provide a suitable mounting for an overhead, so-called drop ceiling supporting structure. Such a structure consists of a rectangular framing of railing or lightweight beam members that is adapted to receive plasterboard or similar ceiling panels. Also, using the present approach, the carpenters and painters have a tedious and difficult time in finishing-off the new wall. For example, the painters spend a lot of time cutting in and out around the ceiling tile or boards and side runners. Also, after all the time and effort spent in finishing a drop ceiling using this system, it does not match the rest of the ceiling molding and trim. It has been a somewhat costly operation using the presently known approach, since it also generally requires two categories of workmen. I thus set out to solve the problem presented.

I have developed a new type of construction that is based on the use of a simple structural member which eliminates the need for disturbing the original ceiling of a room, which can be solely mounted on and supported by the side wall structure of the room and will do so in such a manner as to form a simple, secure and easily mounted, full supporting means for a conventional skeletonized drop ceiling, roof ceiling panel-receiving frame structure. It only requires one type of workman for a complete drop ceiling installation.

I have done this by providing a new form of structural support member 10 that is shown of right-angular shape having an upper, drop ceiling receiving, supporting shelf part 12 and an integral downwardly extending mounting vertical leg part 11.

Figure 1:
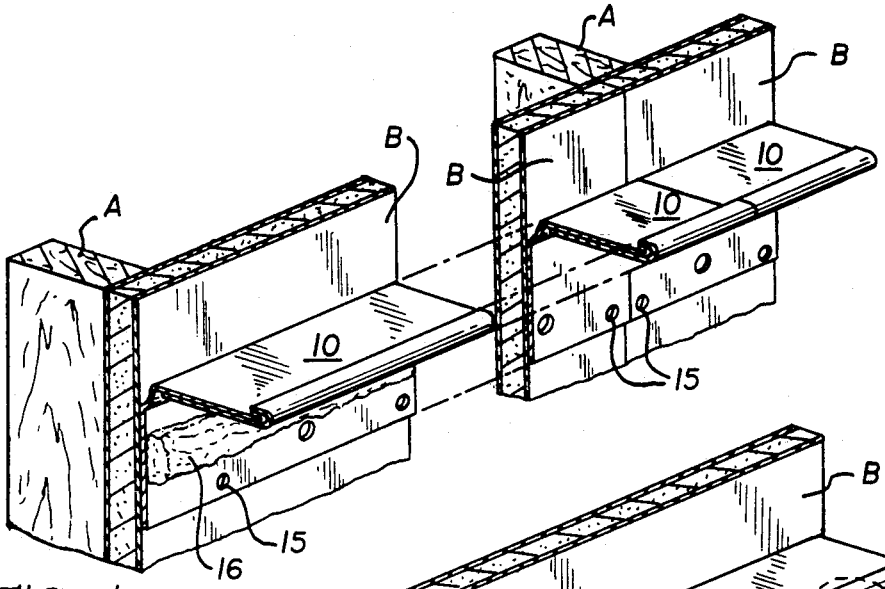
Figure 4:
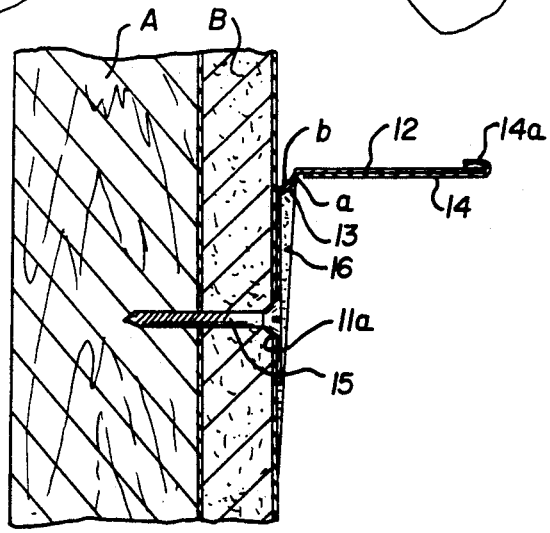
FIG. 4 is an enlarged fragmental side sectional view in elevation showing the final, fully finished, solely side-wall mounted support structure of my invention as effected by a final operation of FIG. 2.

The leg part 11 is, as shown and in accordance with my concept, connected to the upper shelf part 12 in an integral manner by a downwardly offset guide bead 13, and is provided with wall-mounting holes 11*a* in a spaced-apart relation therealong, as well as with anchoring holes 11*b* which are slightly larger and in a staggered relation with respect to the mounting holes 11*a*. As illustrated in FIGS. 1 and 4, suitable room wall mounting elements, such as threaded screws 15, nails or the like, are mounted to extend through the wallboard B, preferably in an anchoring manner with the vertical studding members A which usually have a standard, spaced-apart, upwardly extending relation along the wall structure of a room. It is important in accordance with my invention to not only provide supporting members 10 which will serve as full supports for an entire drop ceiling but to also provide such support members with an associated simple and effective finish along the room exposed portions or parts thereof.

Figure 2:
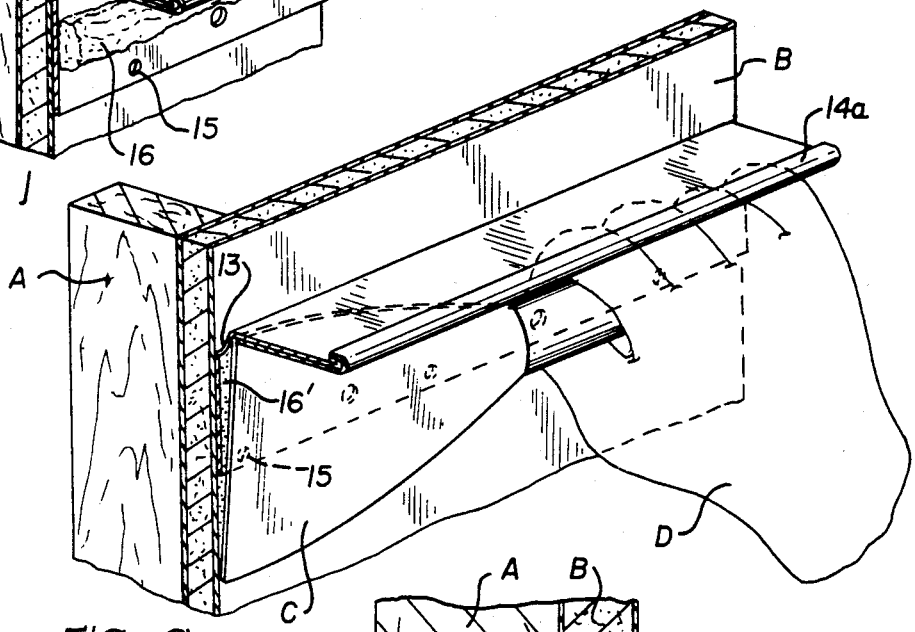
FIG. 2 is a vertical section in elevation on the scale of FIG. 1 through a structural member of my invention in a fully wall-mounted relation, and with its leg part being covered with a finishing compound by an accurately guided, longitudinal sliding, slightly sloped movement of a tool blade therealong.
Figure 3:
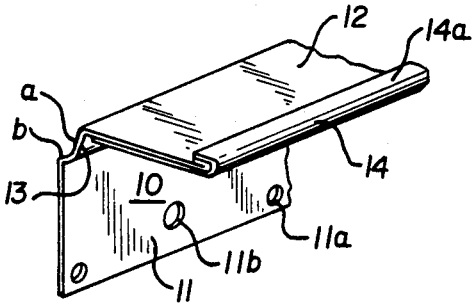
FIG. 3 is a perspective end fragment on the scale of FIGS. 1 and 2 and further illustrating my structural member.

In this connection, the underside of the shelf part 12 is, during the forming of this part provided with a finished or finish-coated cover strip or member 14 of metal or plastic which, as particularly shown in FIGS. 3 and 4, extends substantially fully along the underside of the shelf part 12 and is secured in a smoothly lapped over relation over the front edge of such part at 14*a*. It will be noted from FIG. 4 that the finish strip 14 does not extend into abutment but provides a guide slot with an upwardly concave and a downwardly convex slightly backwardly and downwardly inclined offset guide portion a of the connecting guide bead 13, and terminates in a slightly backwardly spaced relation with respect thereto. Such guide portion a, provides a secure and accurate guide alignment of an edge of a blade C of a suitable smoothing tool, such as a spatula or putty knife, see FIG. 2. In this connection, as shown in FIG. 1, a suitable finishing compound 16 may be roughly applied as a continuous line along a room encircling longitudinally aligned mounted series of the support members 10 as a preliminary step, as by the use of any suitable tool or a feed head from a suitable supply source. Thereafter, as illustrated particularly in FIG. 2, a worker will then insert the blade C of a hand tool in the manner shown. It is thus guidably and accurately held in a downwardly backwardly sloped position while the worker's hand D moves it longitudinally along an endwise-aligned, about the room assembly of structure members 10. In this manner, the finishing of the mounting leg part 11 of each member 10 can be accomplished by one longitudinal manual and accurately guided movement of the tool C to provide a smoothly finished covering coating such as 16, shown in FIG. 4. The material of this coating may be provided with a suitable color to conform to a desired trim coloring for the room about its drop ceiling construction or may, if desired, be painted or covered with a strip of fabric material. However, an after treatment of the applied finishing compound 16 is not necessary in accordance with my invention.

The bead 13 is an important part of my unitary support member construction and as shown particularly in FIGS. 2, 3 and 4 has a slight, backward slope as to its portion and a backwardly open trough-like bottom terminus portion b which connects to the vertical leg part 11. The exposed front side of portion a of the bead 13 serves as an abutment for an upper and major thickness portion of the applied compound 16. The amount of material 16 applied in the initial step of FIG. 1 is sufficient to enable, not only a full coverage of the depth extent of the foot part 15, but also sufficient to extend over its bottom edge and into a vanishing line below it and on the outer face of the wall or wallboard B.

Although not shown, I contemplate using conventional cross-extending metal or wood framing members which will extend across the room and rest on the shelf parts 12 of the above explained, securely mounted, slightly inwardly projected, longitudinally aligned assembly of support members 10. These cross-extending members will form a series of substantially rectangular openings within which conventional drop ceiling panels may be tilted into position in order to provide a complete drop ceiling construction.

I claim:

1. An improved wall mountable member structure for facilitating installation of a wholly room-wall-supported drop ceiling without disturbing the original room ceiling and in such a manner as to, itself, have a room-exposed finish which comprises, an integral longitudinally extending drop ceiling support member for use with like support members for mounting in longitudinal endwise progression on and about walls of a room; said support member having a substantially horizontal upper shelf part for carrying a drop ceiling thereon, and having a downwardly extending side wall mounting vertical leg part provided with spaced-apart hole portions for receiving room wall mounting elements therein; said leg part being provided with means for anchoring a finishing compound in place thereon; said support member having an offset guide bead extending longitudinally therealong; said guide bead having an upwardly concave and downwardly convex side wall that integrally connects said shelf and leg parts and defines a forwardly offset and downwardly open longitudinally extending guide slot portion between said shelf and leg parts; said shelf part having an under face provided with finishing means thereon, said guide slot portion having opposed front and back spaced-apart abutment portions therealong, said leg part being adapted to receive a fed-on longitudinal line of a finishing compound substantially centrally therealong; said concave-convex side wall terminating at its upper edge in said back abutment portion to provide a guide face longitudinally therealong in cooperation with said front abutment portion that retains and guides an edge portion of a blade of a smoothing tool for the compound in a guided relation within said slot portion to accurately longitudinally guide the tool in a slight downwardly inwardly sloped relation along said leg part in such a manner as to accurately smoothly finish-cover said leg part and the wall mounting elements with the finishing compound; said bead being backwardly-downwardly offset from said shelf part; said finishing means being a finish strip secured in an under-covering position along the underface of said shelf part; said strip having a smoothly turned-up and over front rim edge portion that extends on a horizontal plane with an upper face of said shelf part, and said strip having an inner edge portion that defines said front abutment portion.

* * * * *